US011692754B2

(12) United States Patent
Smith et al.

(10) Patent No.: US 11,692,754 B2
(45) Date of Patent: Jul. 4, 2023

(54) ICE MAKER HEATER ASSEMBLIES

(71) Applicant: LEXMARK INTERNATIONAL, INC., Lexington, KY (US)

(72) Inventors: Jerry Wayne Smith, Irvine, KY (US); Russell Edward Lucas, Lexington, KY (US); Calvin Dale Murphy, Georgetown, KY (US); Peter Alden Bayerle, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/151,879

(22) Filed: Jan. 19, 2021

(65) Prior Publication Data

US 2021/0325100 A1 Oct. 21, 2021

Related U.S. Application Data

(60) Provisional application No. 63/093,916, filed on Oct. 20, 2020, provisional application No. 63/064,039, filed on Aug. 11, 2020, provisional application No. 63/013,164, filed on Apr. 21, 2020.

(51) Int. Cl.
*F25C 5/08* (2006.01)

(52) U.S. Cl.
CPC ..... *F25C 5/08* (2013.01); *F25C 2400/10* (2013.01)

(58) Field of Classification Search
CPC ..... F25C 5/08; F25C 2400/10; F25C 1/04
See application file for complete search history.

(56) References Cited

U.S. PATENT DOCUMENTS

| | | | |
|---|---|---|---|
| 3,878,362 | A | 4/1975 | Stinger |
| 4,733,056 | A | 3/1988 | Kojima et al. |
| 5,221,829 | A | 6/1993 | Yahav et al. |
| 5,581,876 | A | 12/1996 | Prabhu et al. |
| 5,663,702 | A | 9/1997 | Shaw, Jr. et al. |
| 5,968,391 | A | 10/1999 | Deo et al. |

(Continued)

FOREIGN PATENT DOCUMENTS

| | | | |
|---|---|---|---|
| CN | 2502618 | Y | 7/2002 |
| CN | 2847768 | Y | 12/2006 |

(Continued)

OTHER PUBLICATIONS

U.S. Appl. No. 17/147,921, filed Jan. 13, 2021 (Smith et al.).

(Continued)

*Primary Examiner* — Cassey D Bauer

(57) ABSTRACT

An ice maker includes an ice mold having an inner surface and an outer surface. The inner surface of the ice mold is configured to retain water for forming ice cubes in the ice mold. The ice mold includes a plurality of ice lobes each shaped to form a respective ice cube in the ice mold. A heater assembly is positioned on the outer surface of the ice mold. In some embodiments, each of a plurality of heating elements of the heater assembly is aligned with a corresponding lobe of the plurality of lobes for supplying heat to ice cubes formed in the lobes for releasing the ice cubes from the ice mold. In some embodiments, the heater assembly includes a heater having a ceramic substrate and one or more electrically resistive traces and electrically conductive traces thick film printed on the ceramic substrate.

16 Claims, 13 Drawing Sheets

(56) References Cited

U.S. PATENT DOCUMENTS

| | | | | |
|---|---|---|---|---|
| 6,222,158 | B1 | 4/2001 | Nakata et al. | |
| 6,433,317 | B1 | 8/2002 | Arx et al. | |
| 6,518,549 | B1 | 2/2003 | Taylor et al. | |
| 6,960,741 | B2 | 11/2005 | Hamilton et al. | |
| 7,005,611 | B2 * | 2/2006 | Hamilton | G03G 15/2064 219/547 |
| 7,241,131 | B1 | 7/2007 | Booth et al. | |
| 7,336,919 | B2 | 2/2008 | Beach et al. | |
| 7,352,988 | B2 | 4/2008 | Beach et al. | |
| 7,671,300 | B2 * | 3/2010 | Lucas | G03G 15/2064 399/329 |
| 8,064,816 | B2 | 11/2011 | Campbell et al. | |
| 9,417,572 | B2 | 8/2016 | Hamilton et al. | |
| 9,551,962 | B2 | 1/2017 | Campbell et al. | |
| 10,025,244 | B2 | 7/2018 | Campbell et al. | |
| 10,274,876 | B2 | 4/2019 | Cao et al. | |
| 2002/0145134 | A1 | 10/2002 | Olding et al. | |
| 2004/0035843 | A1 | 2/2004 | Hamilton et al. | |
| 2005/0205548 | A1 | 9/2005 | Olding et al. | |
| 2006/0065654 | A1 | 3/2006 | Ptasienski | |
| 2006/0096084 | A1 | 5/2006 | Hamilton et al. | |
| 2006/0127686 | A1 | 6/2006 | Meloni | |
| 2007/0278203 | A1 | 12/2007 | Creteau et al. | |
| 2008/0083733 | A1 | 4/2008 | Takai et al. | |
| 2008/0224786 | A1 | 9/2008 | Stolpman et al. | |
| 2009/0272732 | A1 | 11/2009 | Ptasienski | |
| 2010/0124448 | A1 | 5/2010 | Beach et al. | |
| 2014/0369730 | A1 | 12/2014 | Bayerle et al. | |
| 2016/0201965 | A1 * | 7/2016 | Abeygunawardana | F25C 5/08 62/349 |
| 2016/0219651 | A1 | 7/2016 | Gaulard et al. | |
| 2017/0023894 | A1 | 1/2017 | Cao et al. | |
| 2017/0321943 | A1 | 11/2017 | Ji et al. | |
| 2017/0321944 | A1 * | 11/2017 | Sherman | A23G 1/00 |
| 2019/0196372 | A1 | 6/2019 | Cao et al. | |
| 2019/0290877 | A1 | 9/2019 | Potharaju et al. | |
| 2019/0357318 | A1 | 11/2019 | Bassill et al. | |
| 2020/0063975 | A1 | 2/2020 | Song et al. | |
| 2020/0253350 | A1 | 8/2020 | Bayerle et al. | |
| 2020/0253409 | A1 | 8/2020 | Cao et al. | |

FOREIGN PATENT DOCUMENTS

| | | | |
|---|---|---|---|
| CN | 201076357 | Y | 6/2008 |
| CN | 201104066 | Y | 8/2008 |
| CN | 101327102 | A | 12/2008 |
| DE | 102010063454 | A1 | 6/2012 |
| WO | 1997001259 | A1 | 1/1997 |

OTHER PUBLICATIONS

U.S. Appl. No. 17/147,907, filed Jan. 13, 2021 (Smith et al.).

U.S. Appl. No. 17/151,891, filed Jan. 19, 2021 (Smith et al.).

EPO machine translation of CN 2847768 Y (Jyayi Electric Technology Co. Ltd.).

International Search Report and Written Opinion of the International Searching Authority dated Jul. 19, 2021 for PCT Application No. PCT/US2021/025721.

Non-Final Office Action dated Jan. 3, 2023 for U.S. Appl. No. 17/147,921 (Smith et al.).

* cited by examiner

ICE MAKER HEATER ASSEMBLIES

CROSS REFERENCES TO RELATED APPLICATIONS

This application claims priority to U.S. Provisional Patent Application Ser. No. 63/013,164, filed Apr. 21, 2020, entitled "Modular Ceramic Heater Assemblies," to U.S. Provisional Patent Application Ser. No. 63/064,039, filed Aug. 11, 2020, entitled "Modular Ceramic Heater Assemblies Including Heater Assemblies for an Ice Maker," and to U.S. Provisional Patent Application Ser. No. 63/093,916, filed Oct. 20, 2020, entitled "Ice Maker Heater Assemblies," the contents of which are hereby incorporated by reference in their entirety.

BACKGROUND

1. Field of the Disclosure

The present disclosure relates to ice maker heater assemblies.

2. Description of the Related Art

Conventional ice makers, such as ice makers installed in or incorporated into refrigerators and freezers, include a heater assembly positioned underneath the ice maker that supplies heat to the bottom of an ice mold after ice is formed in the mold to loosen ice from a surface of the mold and to permit removal of ice from the mold, e.g., by one or more ejector blades driven by a motor. Existing ice makers often include a Calrod®-type heating element, available from General Electric Company, Schenectady, N.Y., positioned along the outer surface of the bottom of the ice mold. The Calrod®-type heating element includes a coiled nichrome wire, which serves as a resistive heating element, encased by magnesium dioxide, which serves as a heat transfer element, within a metal (steel alloy) sheath. These Calrod®-type heater assemblies have relatively low thermal efficiency leading to an ice making cycle time of as much as 250 minutes or more.

Accordingly, a heater assembly for an ice maker having improved thermal efficiency is desired in order to permit reduced cycle times for faster ice production.

SUMMARY

An ice maker according to one example embodiment includes an ice mold having an inner surface and an outer surface. The inner surface of the ice mold is configured to retain water for forming ice cubes in the ice mold. The ice mold includes a plurality of ice lobes each shaped to form a respective ice cube in the ice mold. A heater assembly is positioned on the outer surface of the ice mold. The heater assembly includes a plurality of heating elements. Each of the plurality of heating elements is aligned with a corresponding lobe of the plurality of lobes for supplying heat to ice cubes formed in the lobes for releasing the ice cubes from the ice mold. The heater assembly includes a plurality of electrical conductors extending between the plurality of lobes and electrically connecting the plurality of heating elements. In some embodiments, the heater assembly is positioned along an underside of the ice mold. Embodiments include those wherein the heater assembly includes a heater having a ceramic substrate, and the plurality of heating elements of the heater assembly are formed by a plurality of electrically resistive traces printed on the ceramic substrate of the heater. In some embodiments, the plurality of electrical conductors are formed by a plurality of electrically conductive traces printed on the ceramic substrate of the heater.

An ice maker according to another example embodiment includes an ice mold having an inner surface and an outer surface. The inner surface of the ice mold is configured to retain water for forming ice cubes in the ice mold. A heater assembly is positioned on the outer surface of the ice mold for supplying heat to ice cubes formed in the ice mold for releasing the ice cubes from the ice mold. The heater assembly includes a heater having a ceramic substrate. The ceramic substrate has at least one electrically resistive trace thick film printed on the ceramic substrate and at least one electrically conductive trace thick film printed on the ceramic substrate. The heater is configured to generate heat when an electric current is supplied to the at least one electrically resistive trace.

An ice maker according to another example embodiment includes an ice mold having an inner surface and an outer surface. The inner surface of the ice mold is configured to retain water for forming ice cubes in the ice mold. The ice mold includes a plurality of ice lobes each shaped to form a respective ice cube in the ice mold. A heater is positioned on the outer surface of the ice mold. The heater includes a ceramic substrate having a plurality of electrically resistive traces positioned on the ceramic substrate and a plurality of electrically conductive traces positioned on the ceramic substrate. The heater is configured to generate heat when an electric current is supplied to the electrically resistive traces. The plurality of electrically resistive traces are spaced along a length of the ceramic substrate such that each of the plurality of electrically resistive traces is aligned with a corresponding lobe of the plurality of lobes for supplying heat to ice cubes formed in the lobes for releasing the ice cubes from the ice mold. The plurality of electrically conductive traces extend between respective pairs of the plurality of lobes and electrically connect the plurality of electrically resistive traces.

An ice maker according to another example embodiment includes an ice mold having an inner surface and an outer surface. The inner surface of the ice mold is configured to retain water for forming ice cubes in the ice mold. The ice mold includes a plurality of ice lobes each shaped to form a respective ice cube in the ice mold. A plurality of heaters are positioned on the outer surface of the ice mold. Each heater of the plurality of heaters includes a ceramic substrate having at least one electrically resistive trace positioned on the ceramic substrate. Each heater of the plurality of heaters is configured to generate heat when an electric current is supplied to the at least one electrically resistive trace. The at least one electrically resistive trace of each heater is aligned with a corresponding lobe of the plurality of lobes for supplying heat to ice cubes formed in the lobes for releasing the ice cubes from the ice mold.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
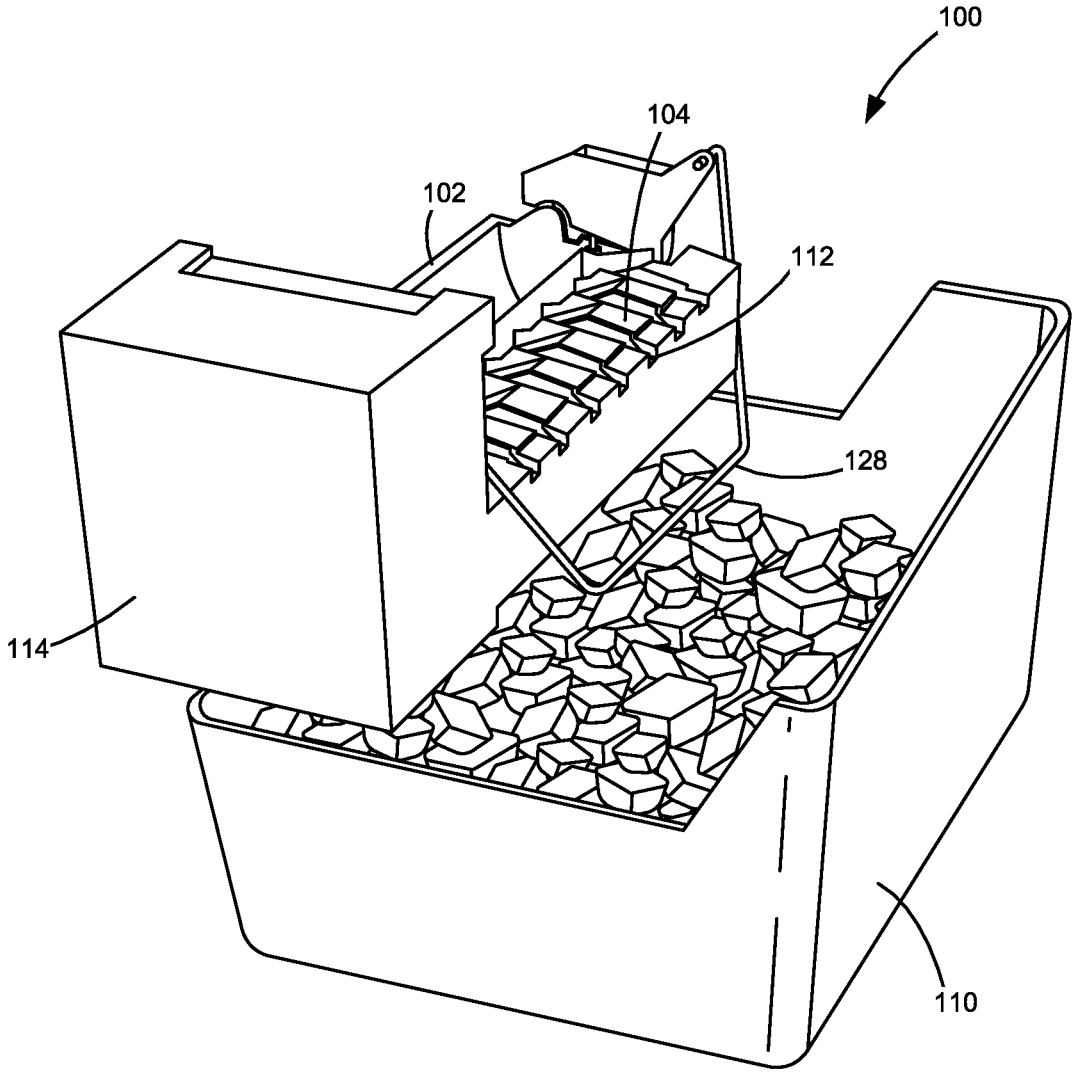
FIG. 1 is a perspective view of an ice maker according to one example embodiment.

FIG. 1 shows an ice maker 100 according to one example embodiment. Ice maker 100 may, for example, be installed in or incorporated into a refrigerator, freezer or the like. Ice maker 100 includes an ice mold 102. Ice mold 102 includes an inner surface that is configured to retain water supplied to ice maker 100 and to form ice cubes when the water held in ice mold 102 freezes. Typically, a cooling unit of the refrigerator or freezer in which ice maker 100 is installed supplies cooled air to maintain a temperature at or below freezing in order to freeze the water in ice mold 102. Although the term "cube" is used, it will be understood that ice cubes may be formed in a variety of shapes other than a true geometric cube including, for example, cubes, half cubes, crescent shapes, nuggets, flakes, etc. In some embodiments, ice mold 102 is composed of a thermally conductive material in order to facilitate efficient cooling of the water in mold 102 to form ice cubes and efficient heating of ice cubes formed in mold 102 to aid in removing the ice cubes from mold 102 as discussed below. In some embodiments, aluminum is advantageous due to its relatively high thermal conductivity and relatively low cost. Aluminum that has been hot forged into a desired shape is often preferable to cast aluminum due to the higher thermal conductivity of forged aluminum.

Ice maker 100 may include a lid or cover 104 positioned above and covering a portion of ice mold 102. Ice maker 100 may also include one or more ejector blades (or other forms of extensions) that extend outward from a rotatable shaft 108 (FIG. 2) and that are positioned to move ice cubes from mold 102 to a bin 110 (or other area for retaining the ice cubes) after the ice cubes are formed and frozen. Cover 104 may include a series of slits 112 (or other forms of openings) through which ice cubes exit mold 102 and through which ejector blades driven by shaft 108 pass during rotation of shaft 108. Ice maker 100 may also include a housing 114 positioned at one end of ice maker 100 that houses various components including, for example, a motor that drives shaft 108, control circuitry of ice maker 100, and other electrical and/or mechanical components.

Figure 2:
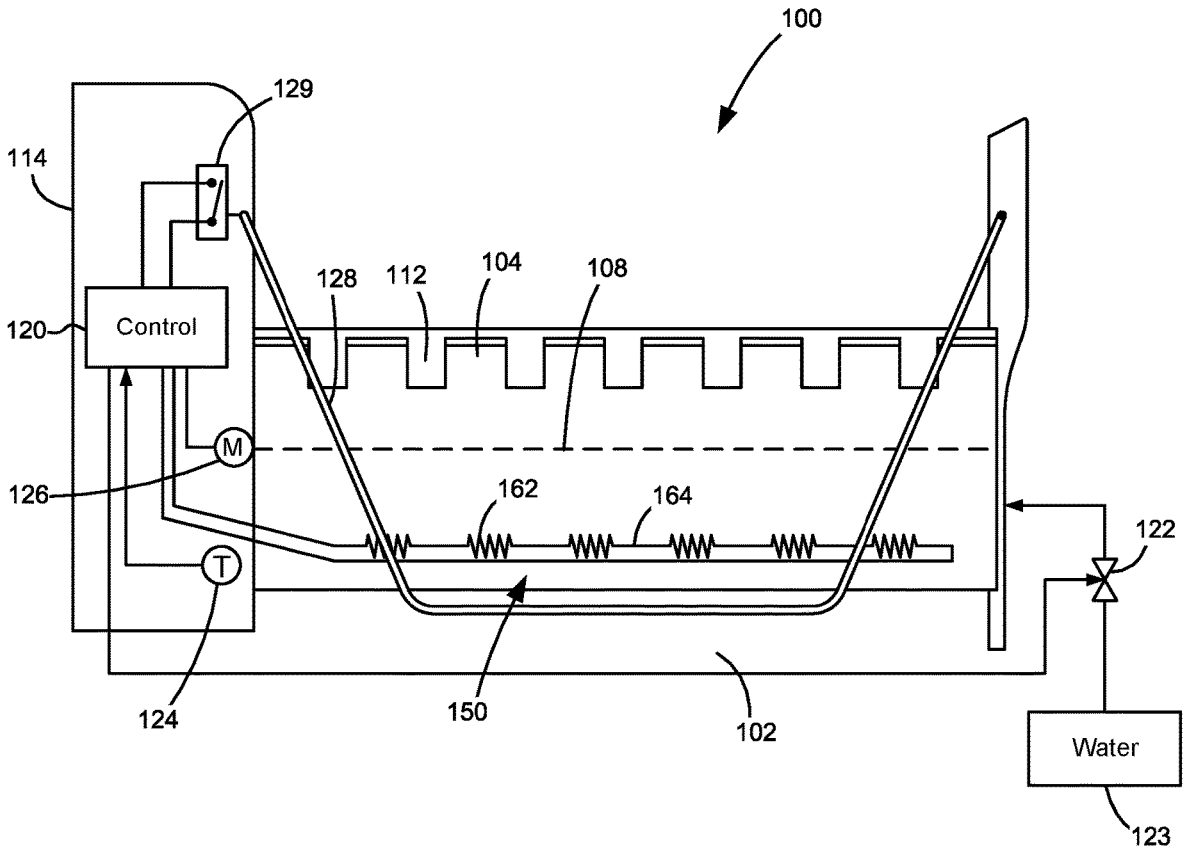
FIG. 2 is a schematic depiction of the ice maker of FIG. 1.

The basic operation of an ice maker, such as ice maker 100, is well known and, therefore, is briefly described herein. With reference to FIG. 2, ice maker 100 includes control circuitry 120 that controls the operation of ice maker 100. In one example, to begin an ice making cycle, control circuitry 120 opens a valve 122 (e.g., a solenoid valve) permitting water to enter ice mold 102 from a water supply 123. Water is typically supplied to ice maker 100 by way of a plumbing line to the refrigerator/freezer in which ice maker 100 is installed. Valve 122 may be opened for a predetermined amount of time sufficient to fill mold 102 with a desired amount of water, and then valve 122 is closed to stop the flow of water into mold 102. A cooling unit, e.g., of the refrigerator/freezer, cools the water in mold 102. A temperature sensor 124, such as a thermistor, thermostat, or the like, positioned in close proximity to mold 102 may provide temperature data to control circuitry 120. Once the temperature falls below a predetermined value indicating that the water in mold 102 is sufficiently frozen, control circuitry 120 switches on a heater assembly 150 for a predetermined amount of time (or until a predetermined temperature is reached) in order to supply heat to the ice in mold 102 to loosen the ice cubes in mold 102 from an inner surface of mold 102. Control circuitry 120 may activate a motor 126 (e.g., concurrently with the activation of heater assembly 150 or shortly after activation of heater assembly 150) that provides rotational motion to shaft 108 in order to rotate shaft 108 and ejector blades rotatable therewith to push the ice cubes out of mold 102 and into bin 110. Control circuitry 120 causes motor 126 to rotate a predetermined amount sufficient to clear the ice from mold 102. The rotation of motor 126 and shaft 108 may also lift a shut-off arm 128 pivotally attached to ice maker 100. Further rotation of motor 126 and shaft 108 permits shut-off arm 128 to fall via gravity until shut-off arm 128 either (a) contacts and rests on the top surface of the ice in bin 110 or (b) reaches a downward rotational stop of shut-off arm 128. Shut-off arm 128 is operatively connected to a switch 129, such as a mechanical switch or an electronic switch.

After rotation of motor 126 is completed, control circuitry 120 checks the status of switch 129 connected to shut-off arm 128. If switch 129 is in a first state indicating that shut-off arm 128 is positioned below a predetermined point such that bin 110 has additional capacity available for ice, control circuitry 120 initiates another ice making cycle by opening water valve 122. If, on the other hand, switch 129 is in a second state indicating that shut-off arm 128 is positioned above the predetermined point such that bin 110 is full, control circuitry 120 delays the next ice making cycle until switch 129 changes from the second state to the first state indicating that the position of shut-off arm 128 has fallen below the predetermined point such that bin 110 has sufficient capacity to receive additional ice. Delaying the next ice making cycle may include delaying the opening of valve 122 to fill mold 102 with water, or it may include opening valve 122 and filling mold 102 with water but delaying removal of ice from mold 102 by heater assembly 150 and ejector blades of shaft 108 until bin 110 has sufficient capacity to receive additional ice.

Figure 3:
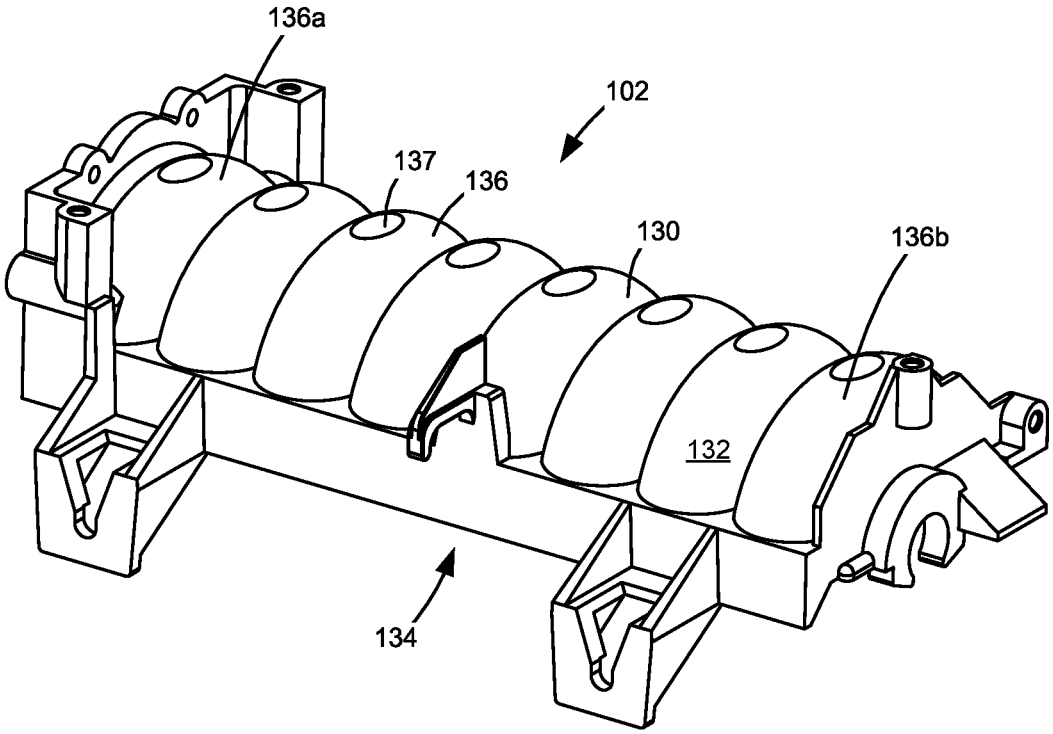
FIG. 3 is a perspective view of a bottom portion of an ice mold of the ice maker according to one example embodiment.

FIG. 3 shows an underside 130 of ice mold 102 according to one example embodiment. Ice mold 102 includes an outer surface 132 and an inner surface 134. Inner surface 134 contacts the water held in ice mold 102 during ice formation. Outer surface 132 is positioned opposite inner surface 134. Inner surface 134 of ice mold 102 includes a plurality of individual cavities or lobes 136 formed therein. Each lobe 136 is shaped and positioned to form a respective ice cube when the water held in mold 102 is frozen. In the embodiment illustrated, lobes 136 are correspondingly formed in outer surface 132 of mold 102 as well as inner surface 134. In some embodiments, a thickness of walls forming mold 102 is thinner at a heating position 137 of each lobe 136, where a corresponding heating element is positioned against each lobe 136 as discussed in greater detail below, than portions of walls forming mold 102 further from heating positions 137 of lobes 136.

Figure 4:
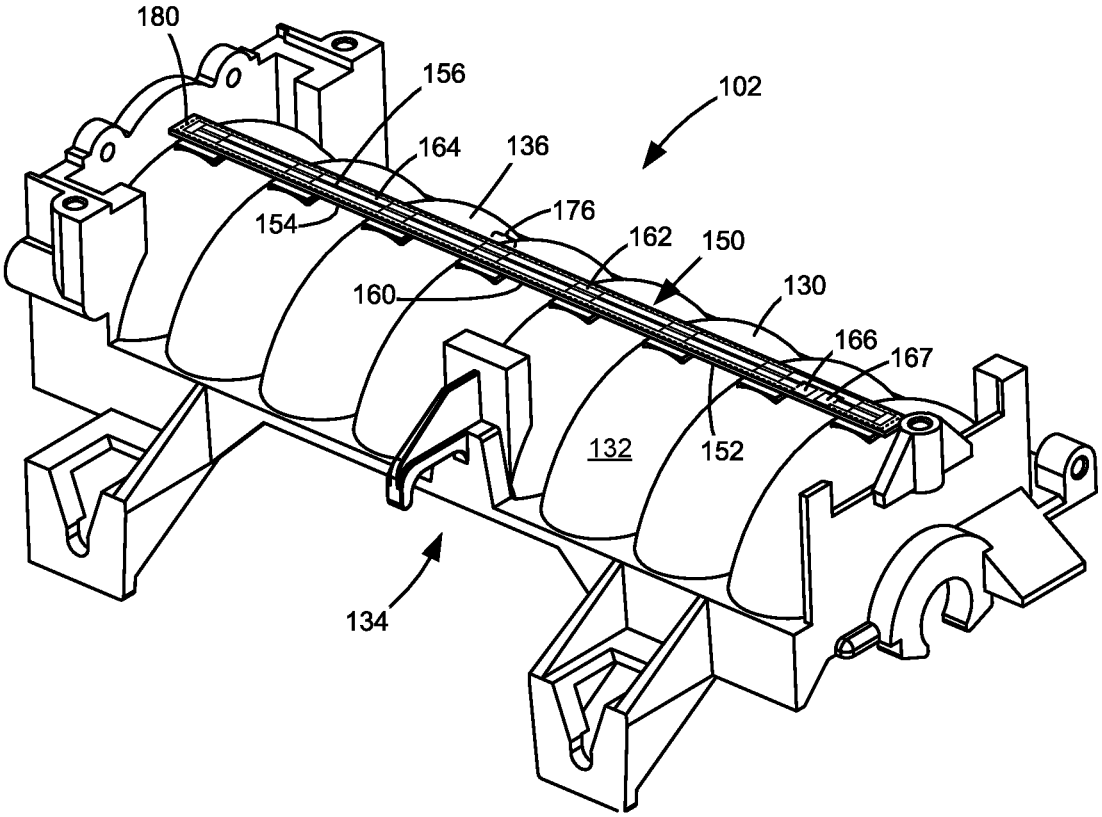
FIG. 4 is a perspective view of the bottom portion of the ice mold of the ice maker having a heater assembly according to a first example embodiment.

FIG. 4 shows a heater assembly 150 of ice maker 100 according to one example embodiment. In the embodiment illustrated, heater assembly 150 includes a single heater 152 positioned on outer surface 132 of mold 102, along underside 130 of mold 102. Heater 152 has an inner face 154 that faces toward outer surface 132 of underside 130 of mold 102 and an outer face 156 that faces away from outer surface 132 of underside 130 of mold 102. As discussed in greater detail below, heater 152 includes a ceramic substrate 160 (e.g., commercially available 96% aluminum oxide ceramic) having a series of one or more electrically resistive traces 162 and electrically conductive traces 164 positioned on ceramic substrate 160. Resistive trace(s) 162 include a suitable electrical resistor material such as, for example, silver palladium (e.g., blended 70/30 silver palladium). Heat is generated when an electrical current is passed through resistive trace(s) 162. Conductive traces 164 include a suitable electrical conductor material such as, for example, silver platinum. Conductive traces 164 provide electrical connections to and between resistive trace(s) 162. In the embodiment illustrated, one or more resistive traces 162 are positioned at or aligned with each lobe 136 of mold 102 in order to efficiently supply heat to each lobe 136 to free ice cubes formed in lobes 136 from inner surface 134 of mold 102 upon activation of heater assembly 150 by control circuitry 120. Conductive traces 164 extend between lobes 136 of mold 102 in order to electrically connect the resistive trace(s) 162 of adjacent lobes 136. Conductive traces 164 also form a pair of terminals 166, 167 of heater 152. A voltage connector may be connected to terminals 166, 167 in order to electrically connect resistive traces 162 and conductive traces 164 to a voltage source of ice maker 100 (e.g., a voltage source of the refrigerator or freezer in which ice maker 100 is installed) and control circuitry 120 that selectively closes the circuit formed by resistive traces 162 and conductive traces 164 in order to generate heat.

Figure 5:
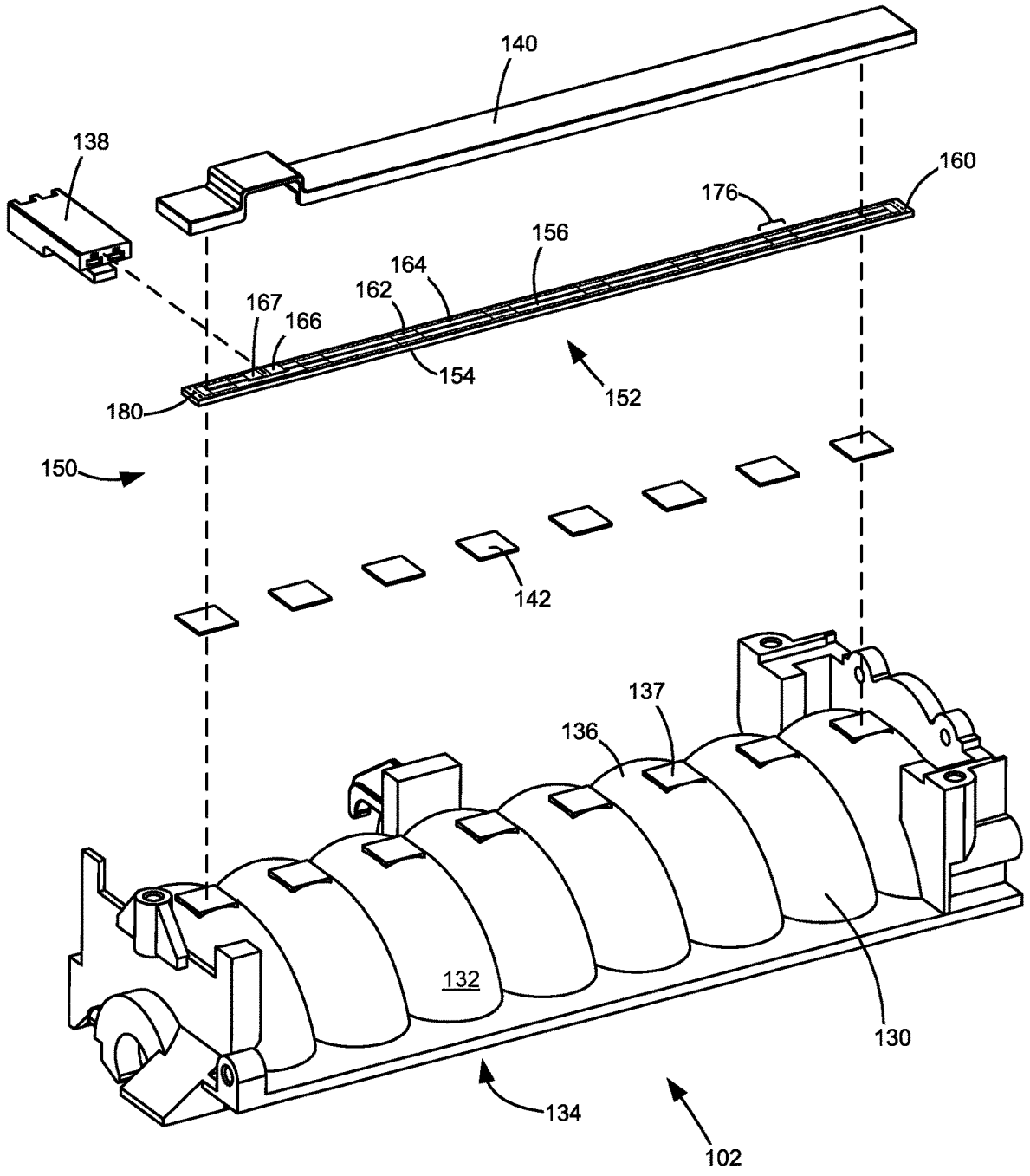
FIG. 5 is an exploded view showing additional features of the ice mold and the heater assembly of FIG. 4 according to one example embodiment.

With reference to FIG. 5, heater assembly 150 includes a voltage connector 138 that electrically connects the voltage source of ice maker 100 and control circuitry 120 to terminals 166, 167 of heater 152. In the example embodiment illustrated, a single voltage connector 138 having a pair of electrical contacts (e.g., spring-loaded electrical contacts) that each contact a respective terminal 166, 167 of heater 152 is used. In other embodiments, a separate voltage connector electrically contacts each terminal 166, 167. While the example embodiment illustrated includes a voltage connector 138 that facilitates an electrical connection between heater 152 and the voltage source of ice maker 100 and control circuitry 120, it will be appreciated that an electrical connection may be established by any suitable means as desired including, for example, by soldering or welding a wire, cable, busbar or other form of electrical contact to each terminal 166, 167.

In the example embodiment illustrated, heater assembly 150 includes a cover 140 that substantially covers outer face 156 of heater 152. Cover 140 provides electrical and thermal insulation of heater 152. Cover 140 may be composed of a suitable plastic material, such as, for example, polyphenylene sulfide (PPS) plastic, liquid-crystal polymer (LCP) plastic, polyethylene terephthalate (PET) plastic, or polyether ether ketone (PEEK) plastic. As desired, thermally insulative pads or other forms of thermal insulation (e.g., silicone rubber or silicone foam) may be applied to outer face 156 of heater 152 (e.g., between cover 140 and outer face 156 of heater 152 and/or against an outer surface of cover 140) in order to reduce heat loss and improve heat transfer from heater 152 to mold 102. Heat transfer from heater 152 to mold 102 may also be improved by attaching heater 152 to ice mold 102 using a thermally conductive, high temperature resistant double-sided tape or a thermally conductive adhesive or gap filler 142 positioned between inner face 154 of heater 152 and outer surface 132 of mold 102. As desired, springs or other biasing features may also be used to force heater 152 toward outer surface 132 of mold 102 to improve heat transfer.

Figure 6:
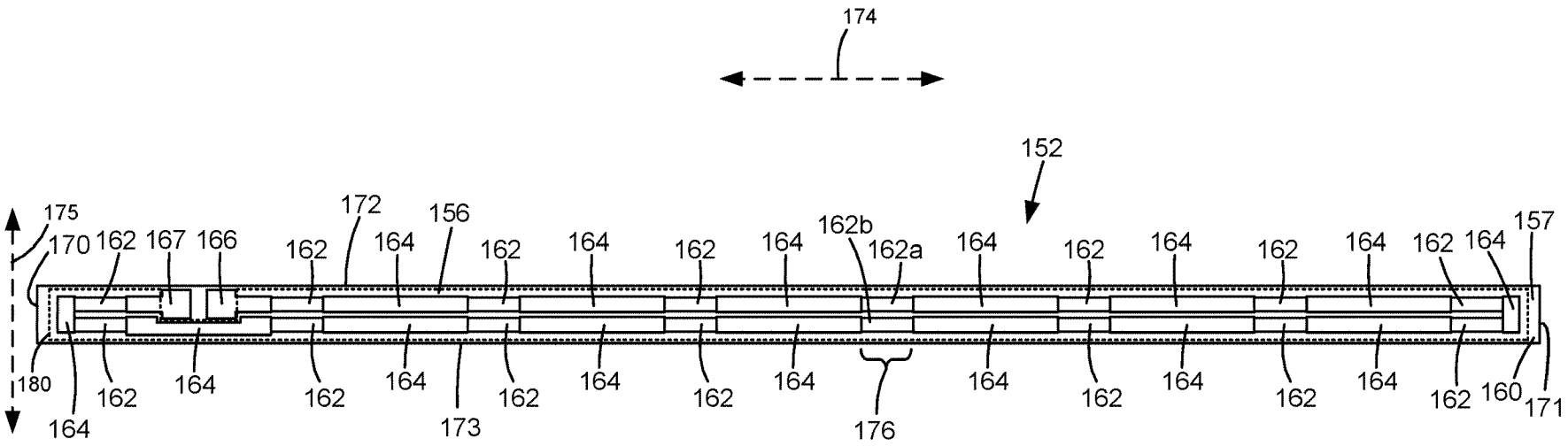
FIG. 6 is a plan view of a heater of the heater assembly shown in FIGS. 4 and 5 according to one example embodiment.

FIG. 6 shows outer face 156 of heater 152 according to one example embodiment. In the embodiment illustrated, inner face 154 and outer face 156 of heater 152 are bordered by four sides or edges, including lateral edges 170 and 171 and longitudinal edges 172 and 173, each having a smaller surface area than inner face 154 and outer face 156. In this embodiment, inner face 154 and outer face 156 are rectangular; however, other shapes may be used as desired (e.g., other polygons such as a square). In the embodiment illustrated, heater 152 includes a longitudinal dimension 174 that extends from lateral edge 170 to lateral edge 171 and a lateral dimension 175 that extends from longitudinal edge 172 to longitudinal edge 173. Heater 152 also includes an overall thickness measured from inner face 154 to outer face 156.

As discussed above, heater 152 includes one or more layers of a ceramic substrate 160. Ceramic substrate 160 includes an outer face 157 that is oriented toward outer face 156 of heater 152 and an inner face that is oriented toward inner face 154 of heater 152. Outer face 157 and an inner face of ceramic substrate 160 are positioned on exterior portions of ceramic substrate 160 such that if more than one layer of ceramic substrate 160 is used, outer face 157 and an inner face of ceramic substrate 160 are positioned on opposed external faces of ceramic substrate 160 rather than on interior or intermediate layers of ceramic substrate 160.

In the example embodiment illustrated, inner face 154 of heater 152 is formed by an inner face of ceramic substrate 160. In this embodiment, outer face 157 of ceramic substrate 160 includes a series of one or more electrically resistive traces 162 and electrically conductive traces 164 positioned thereon as discussed above. In the embodiment illustrated, resistive traces 162 and conductive traces 164 are applied to ceramic substrate 160 by way of thick film printing. For example, resistive traces 162 may include a resistor paste having a thickness of 10-13 microns when applied to ceramic substrate 160, and conductive traces 164 may include a conductor paste having a thickness of 9-15 microns when applied to ceramic substrate 160. Resistive traces 162 form respective heating elements 176 of heater 152, and conductive traces 164 provide electrical connections to and between resistive traces 162 in order to supply an electrical current to each resistive trace 162 to generate heat.

In the example embodiment illustrated, terminals 166, 167 are positioned adjacent to each other along longitudinal edge 172, near lateral edge 170 of heater 152. In the embodiment illustrated, resistive traces 162 and conductive traces 164 extend in an alternating pattern along a rectangular path on outer face 157 of ceramic substrate 160. Heating elements 176 formed by resistive traces 162 are positioned to align with corresponding lobes 136 of ice mold 102 when heater 152 is installed on ice mold 102. In the embodiment illustrated, heating elements 176 are arranged in a spaced relationship from each other along longitudinal dimension 174. In this embodiment, each heating element 176 includes a first resistive trace 162*a* positioned along longitudinal edge 172 and a second resistive trace 162*b* positioned along longitudinal edge 173. Conductive traces 164 extend along longitudinal edges 172, 173 and lateral edges 170, 171 in order to electrically connect adjacent resistive traces 162 and to complete the circuit formed by resistive traces 162 and conductive traces 164 between terminals 166, 167. In this embodiment, resistive traces 162 extend generally parallel to each other and to longitudinal edges 172, 173 of heater 152. Conductive traces 164 at lateral ends 170, 171 of heater 152 extend generally perpendicular to resistive traces 162 and parallel to lateral ends 170, 171 of heater 152. The remaining conductive traces 164 extend generally parallel to resistive traces 162 and to longitudinal edges 172, 173 of heater 152.

In the embodiment illustrated, heater 152 includes one or more layers of printed glass 180 on outer face 157 of ceramic substrate 160. In the embodiment illustrated, glass 180 covers resistive traces 162 and conductive traces 164, except for the portions of conductive traces 164 forming terminals 166, 167, in order to electrically insulate such features to prevent electric shock or arcing. The borders of glass layer 180 are shown in dotted line in FIGS. 4-7. An overall thickness of glass 180 may range from, for example, 70-80 microns.

Heater 152 may be constructed by way of thick film printing. For example, in one embodiment, resistive traces 162 are printed on fired (not green state) ceramic substrate 160, which includes selectively applying a paste containing resistor material to ceramic substrate 160 through a patterned mesh screen with a squeegee or the like. The printed resistor is then allowed to settle on ceramic substrate 160 at room temperature. The ceramic substrate 160 having the printed resistor is then heated at, for example, approximately 140-160 degrees Celsius for a total of approximately 30 minutes, including approximately 10-15 minutes at peak temperature and the remaining time ramping up to and down from the peak temperature, in order to dry the resistor paste and to temporarily fix resistive traces 162 in position. The ceramic substrate 160 having temporary resistive traces 162 is then heated at, for example, approximately 850 degrees Celsius for a total of approximately one hour, including approximately 10 minutes at peak temperature and the remaining time ramping up to and down from the peak temperature, in order to permanently fix resistive traces 162 in position. Conductive traces 164 are then printed on ceramic substrate 160, which includes selectively applying a paste containing conductor material in the same manner as the resistor material. The ceramic substrate 160 having the printed resistor and conductor is then allowed to settle, dried and fired in the same manner as discussed above with respect to resistive traces 162 in order to permanently fix conductive traces 164 in position. Glass layer(s) 180 are then printed in substantially the same manner as the resistors and conductors, including allowing the glass layer(s) 180 to settle as well as drying and firing the glass layer(s) 180. In one embodiment, glass layer(s) 180 are fired at a peak temperature of approximately 810 degrees Celsius, slightly lower than the resistors and conductors.

Thick film printing resistive traces 162 and conductive traces 164 on fired ceramic substrate 160 provides more uniform resistive and conductive traces in comparison with conventional ceramic heaters, which include resistive and conductive traces printed on green state ceramic. The improved uniformity of resistive traces 162 and conductive traces 164 provides more uniform heating across inner face 154 of heater 152 as well as more predictable heating of heater 152.

While the example embodiment illustrated in FIGS. 4-7 includes resistive traces 162, and the heating elements 176 formed thereby, positioned on outer face 157 of ceramic substrate 160, in other embodiments, resistive traces 162, and the heating elements 176 formed thereby, may be positioned on an inner face of ceramic substrate 160 along with corresponding conductive traces as needed to establish electrical connections thereto. Glass 180 may cover the resistive traces and conductive traces on outer face 157 and/or an inner face of ceramic substrate 160 as desired in order to electrically insulate such features.

Figure 7:
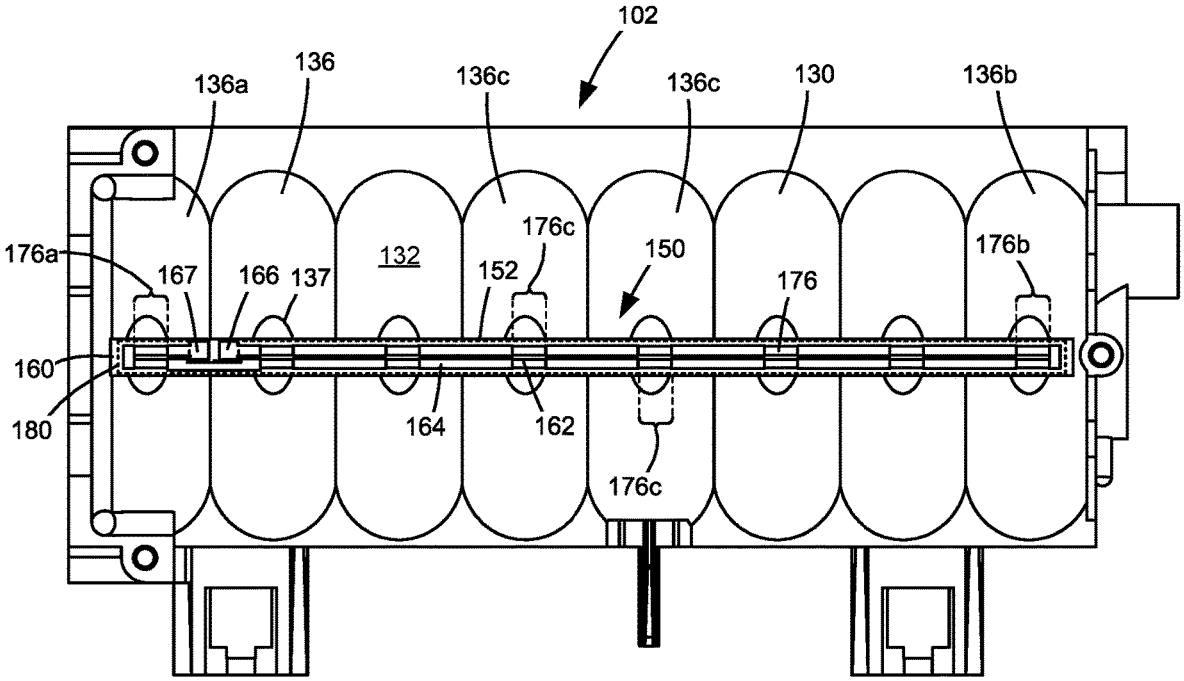
FIG. 7 is a bottom plan view of the ice mold and the heater assembly of FIG. 4 according to one example embodiment.

FIG. 7 shows underside 130 of ice mold 102 with heater 152 installed thereon. As discussed above, in the embodiment illustrated, heating elements 176 of heater 152 are aligned with corresponding lobes 136 of mold 102 in order to efficiently supply heat to each lobe 136 to free ice cubes formed in lobes 136 from inner surface 134 of mold 102 upon activation of heater assembly 150 by control circuitry 120. In the embodiment illustrated, each heating element 176 includes a pair of resistive traces 162 aligned with each lobe 136 of mold 102. However, in other embodiments, each heating element 176 may include a single resistive trace 162 or more than two resistive traces 162 as desired. Conductive traces 164 extend between lobes 136 of mold 102 in order to electrically connect each heating element 176.

Figure 8:
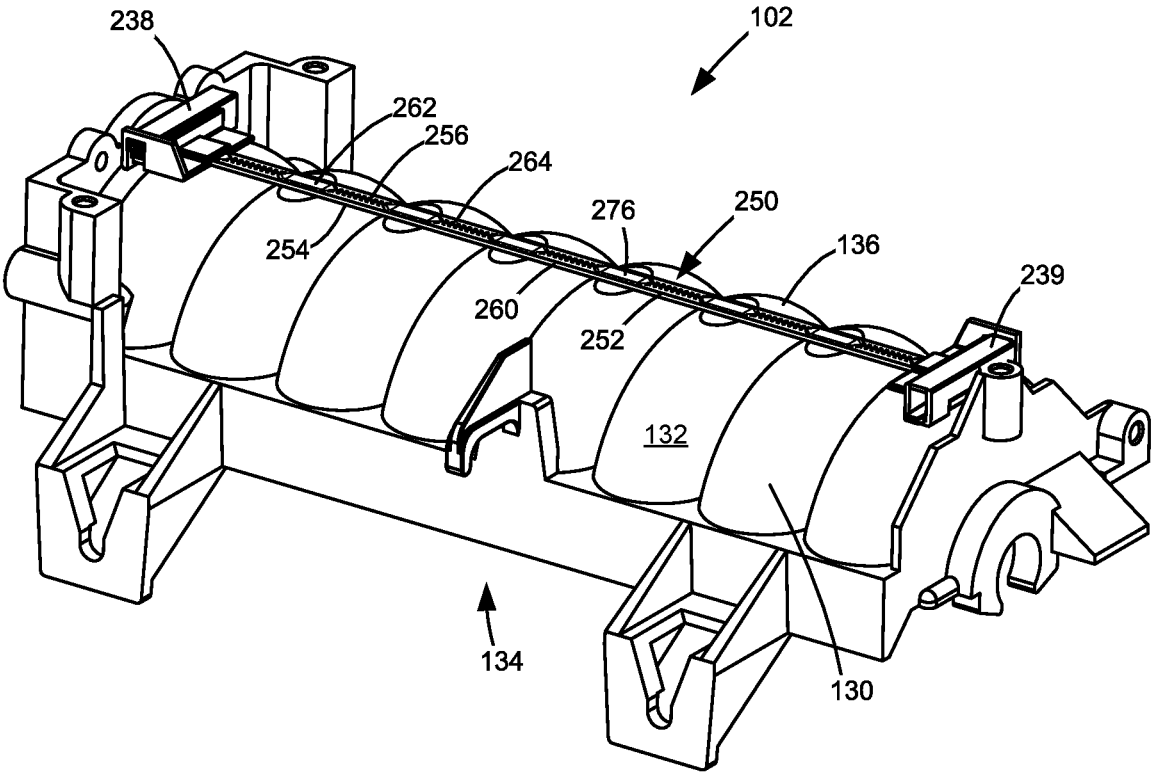
FIG. 8 is a perspective view of the bottom portion of the ice mold of the ice maker having a heater assembly according to a second example embodiment.

FIG. 8 shows a heater assembly 250 of ice maker 100 according to another example embodiment. In the embodiment illustrated, heater assembly 250 includes a single heater 252 positioned on outer surface 132 of mold 102, along underside 130 of mold 102. Heater 252 has an inner face 254 that faces toward outer surface 132 of underside 130 of mold 102 and an outer face 256 that faces away from outer surface 132 of underside 130 of mold 102. Like heater 152 discussed above, heater 252 includes a ceramic substrate 260 having a series of one or more electrically resistive traces 262 and electrically conductive traces 264 positioned on ceramic substrate 260. Heat is generated when an electrical current is passed through resistive trace(s) 262 in order to free ice cubes formed in lobes 136 from inner surface 134 of mold 102 upon activation of heater assembly 250 by control circuitry 120. Conductive traces 264 provide electrical connections to and between resistive trace(s) 262. Conductive traces 264 also form a pair of terminals 266, 267 (FIG. 9) of heater 252.

In this embodiment, a respective voltage connector 238, 239 is connected to each terminal 266, 267 in order to electrically connect resistive traces 262 and conductive traces 264 to the voltage source of ice maker 100 and control circuitry 120 that selectively closes the circuit formed by resistive traces 262 and conductive traces 264 to generate heat. Each voltage connector 238, 239 includes a respective electrical contact (e.g., a spring-loaded electrical contact) that contacts a corresponding terminal 266, 267 of heater 252. As discussed above, although a pair of voltage connectors 238, 239 are illustrated, an electrical connection to terminals 266, 267 may be established by any suitable means as desired.

Although not shown in FIG. 8, heater assembly 250 may include a cover and thermal insulation as desired. Further, a thermal tape, adhesive or gap filler may be positioned between inner face 254 of heater 252 and outer surface 132 of mold 102 in order to improve heat transfer as desired, and springs or other biasing features may force heater 252 toward outer surface 132 of mold 102 as desired.

Figure 9:
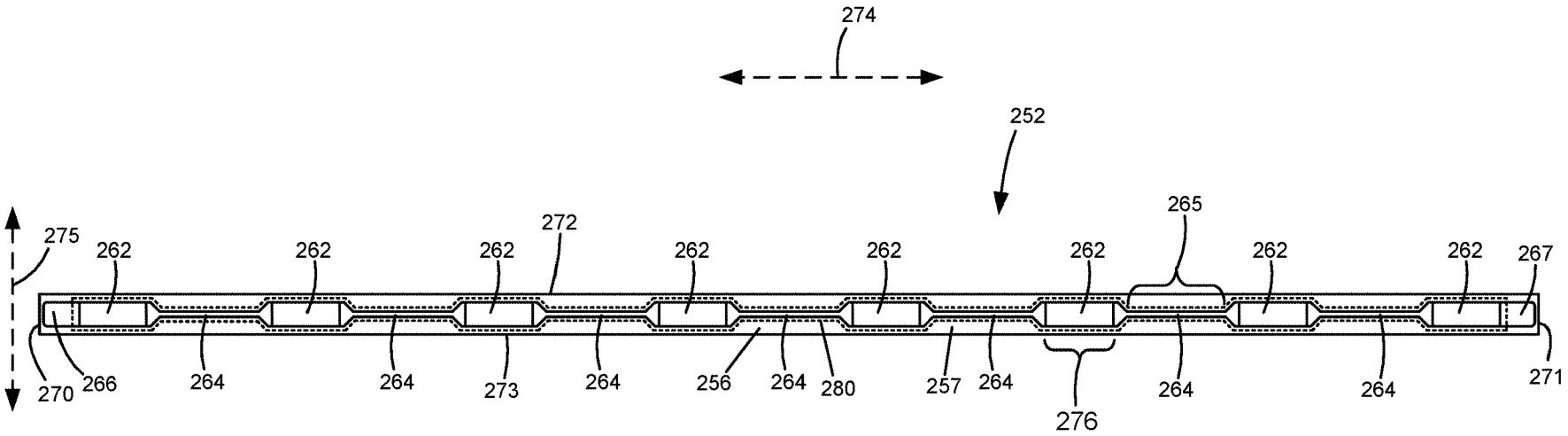
FIG. 9 is a plan view of a heater of the heater assembly shown in FIG. 8 according to one example embodiment.

FIG. 9 shows outer face 256 of heater 252 according to one example embodiment. In the embodiment illustrated, inner face 254 and outer face 256 of heater 252 are bordered by four sides or edges, including lateral edges 270 and 271 and longitudinal edges 272 and 273, each having a smaller surface area than inner face 254 and outer face 256. In this embodiment, inner face 254 and outer face 256 are rectangular; however, other shapes may be used as desired (e.g., other polygons such as a square). In the embodiment illustrated, heater 252 includes a longitudinal dimension 274 that extends from lateral edge 270 to lateral edge 271 and a lateral dimension 275 that extends from longitudinal edge 272 to longitudinal edge 273. Heater 252 also includes an overall thickness measured from inner face 254 to outer face 256.

As discussed above, heater 252 includes one or more layers of a ceramic substrate 260. Ceramic substrate 260 includes an outer face 257 that is oriented toward outer face 256 of heater 252 and an inner face that is oriented toward inner face 254 of heater 252. Outer face 257 and an inner face of ceramic substrate 260 are positioned on exterior portions of ceramic substrate 260 such that if more than one layer of ceramic substrate 260 is used, outer face 257 and an inner face of ceramic substrate 260 are positioned on opposed external faces of the ceramic substrate 260 rather than on interior or intermediate layers of ceramic substrate 260.

In the example embodiment illustrated, inner face 254 of heater 252 is formed by an inner face of ceramic substrate 260. In this embodiment, outer face 257 of ceramic substrate 260 includes a series of one or more electrically resistive traces 262 and electrically conductive traces 264 positioned thereon as discussed above. Resistive traces 262 and conductive traces 264 may be applied to ceramic substrate 260 by way of thick film printing as discussed above.

In the example embodiment illustrated, terminals 266, 267 are positioned at opposite ends of heater 252 along longitudinal dimension 274 such that terminal 266 is positioned adjacent to lateral edge 270 and terminal 267 is positioned adjacent to lateral edge 271. The positioning of terminals 266, 267 at opposite ends of heater 252 allows the overall width of heater 252 along lateral dimension 275 to be narrower in comparison with, for example, a width of heater 152 along lateral dimension 175 where electrical connection to both terminals 166, 167 is made near one end of heater 152. The reduced width of heater 252 helps reduce the thermal mass of heater 252 in order to improve the thermal efficiency of heater assembly 250.

In the embodiment illustrated, resistive traces 262 and conductive traces 264 form an alternating pattern in a single file arrangement on outer face 257 of ceramic substrate 260 that extends along longitudinal dimension 274 from terminal 266 to terminal 267. Resistive traces 262 form respective heating elements 276 of heater 252. Heating elements 276 are positioned to align with corresponding lobes 136 of ice mold 102 when heater 252 is installed on ice mold 102. In the embodiment illustrated, heating elements 276 are arranged in a spaced relationship from each other along longitudinal dimension 274. In the example embodiment illustrated, each heating element 276 includes a single resistive trace 262. Conductive traces 264 extend between and electrically connect adjacent resistive traces 262 to complete the circuit formed by resistive traces 262 and conductive traces 264 between terminals 266, 267. In the embodiment illustrated, resistive traces 262 and conductive traces 264 extend generally parallel to each other and to longitudinal edges 272, 273 of heater 252. In the embodiment illustrated, each conductive trace 264 tapers inward along lateral dimension 275, away from longitudinal edges 272, 273 as the conductive trace 264 extends away from the respective resistive traces 262 in contact with the conductive trace 264 such that a central portion 265 of each conductive trace 264 has a smaller width along lateral dimension 275 than a width of resistive traces 262 along lateral dimension 275. The reduced width of central portions 265 of conductive traces 264 also helps reduce the thermal mass of heater 252.

In the embodiment illustrated, heater 252 includes one or more layers of printed glass 280 on outer face 257 of ceramic substrate 260 as discussed above. In the embodiment illustrated, glass 280 covers resistive traces 262 and conductive traces 264, except for portions of terminals 266, 267, in order to electrically insulate such features. The borders of glass layer 280 are shown in dotted line in FIGS. 8-10.

Figure 10:
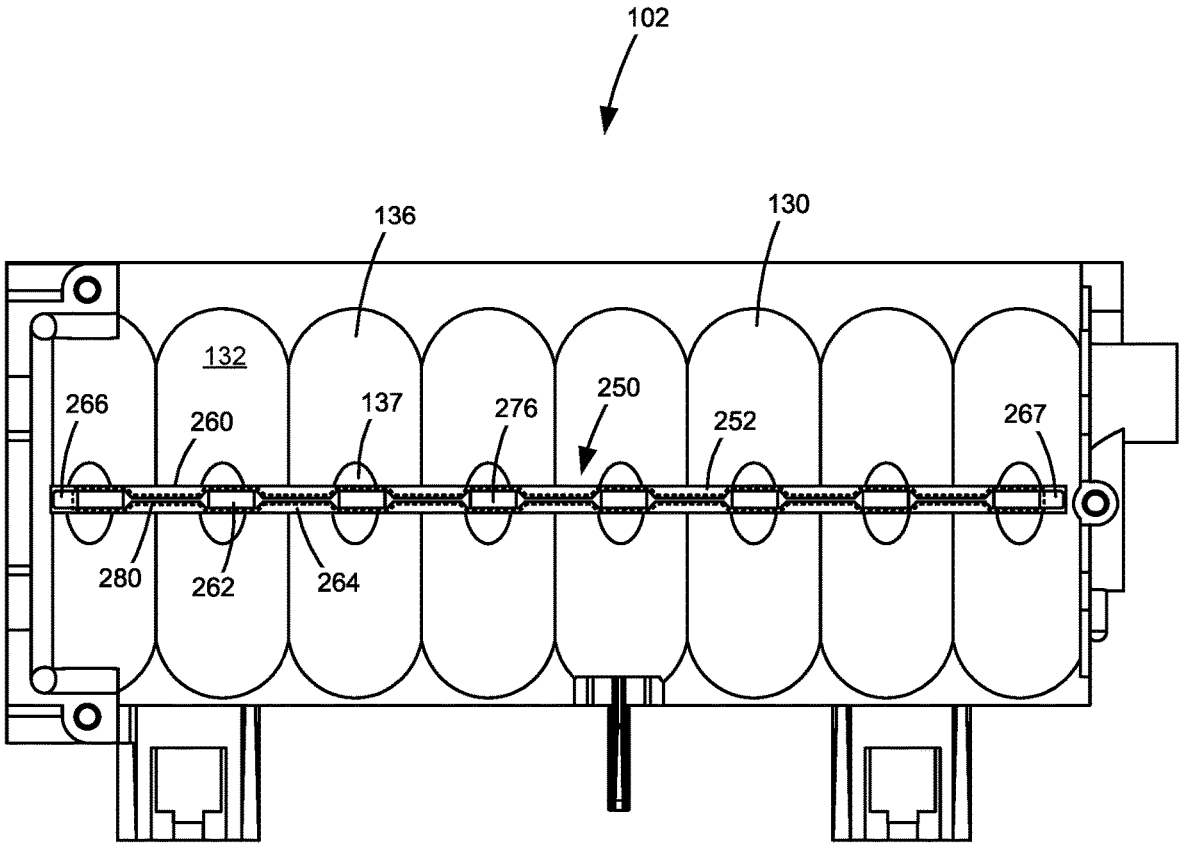
FIG. 10 is a bottom plan view of the ice mold and the heater assembly of FIG. 8 according to one example embodiment.

While the example embodiment illustrated in FIGS. 8-10 includes resistive traces 262, and the heating elements 276 formed thereby, positioned on outer face 257 of ceramic substrate 260, as discussed above, in other embodiments, resistive traces 262, and the heating elements 276 formed thereby, may be positioned on an inner face of ceramic substrate 260 along with corresponding conductive traces as needed to establish electrical connections thereto. Glass 280 may cover the resistive traces and conductive traces on outer face 257 and/or an inner face of ceramic substrate 260 as desired in order to electrically insulate such features.

FIG. 10 shows underside 130 of ice mold 102 with heater 252 installed thereon. Heating elements 276 of heater 252 are aligned with corresponding lobes 136 of mold 102 in order to efficiently supply heat to each lobe 136 to free ice cubes formed in lobes 136 from inner surface 134 of mold 102 upon activation of heater assembly 250 by control circuitry 120. In the embodiment illustrated, each heating element 276 includes a resistive trace 262 aligned with each lobe 136 of mold 102. However, in other embodiments, each heating element 276 may include more than one resistive trace 262 as desired. Conductive traces 264 extend between lobes 136 of mold 102 in order to electrically connect each heating element 276.

Figure 11:
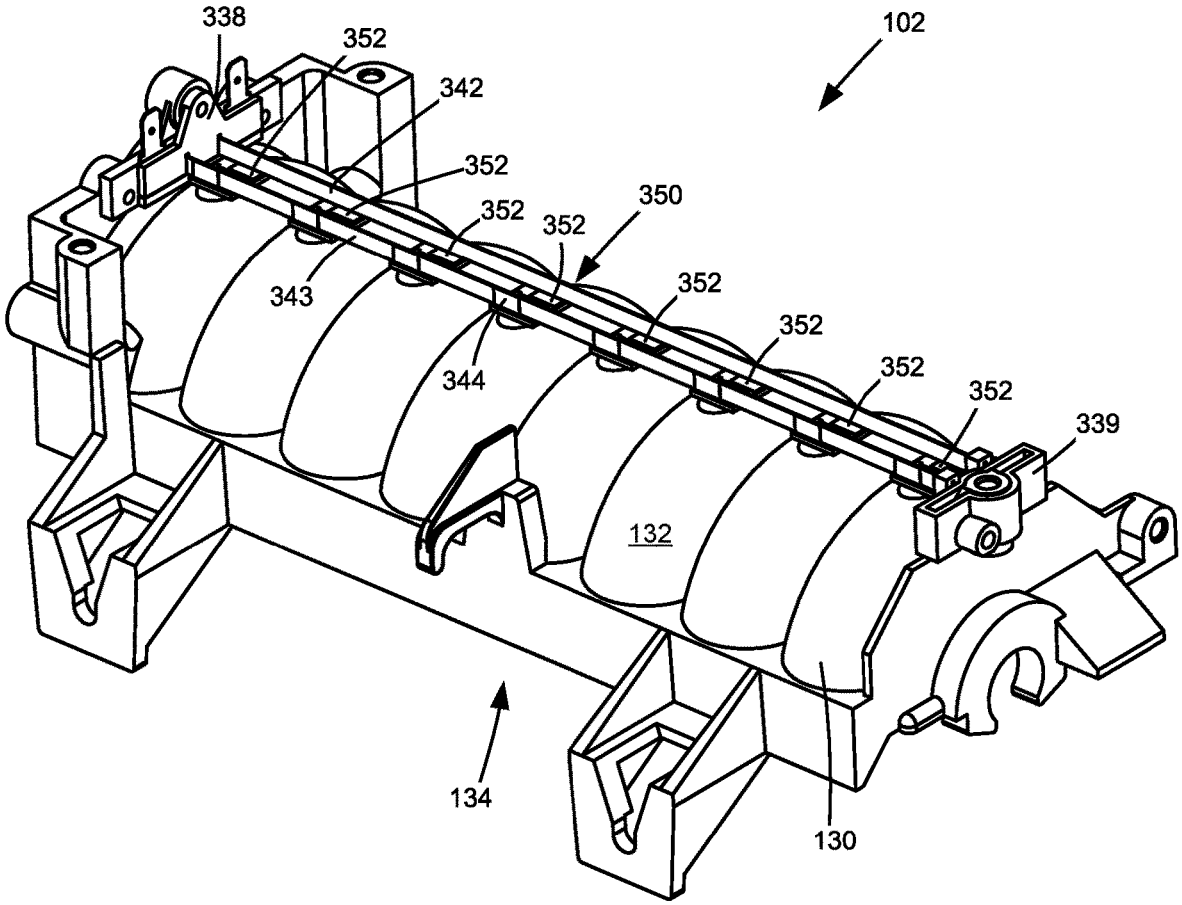
FIG. 11 is a perspective view of the bottom portion of the ice mold of the ice maker having a heater assembly according to a third example embodiment.

FIG. 11 shows a heater assembly 350 of ice maker 100 according to another example embodiment. In the embodiment illustrated, heater assembly 350 includes a plurality of heaters 352 positioned on outer surface 132 of mold 102, along underside 130 of mold 102. Heaters 352 are spaced along outer surface 132 of mold 102 in order to selectively apply heat to mold 102 upon activation of heater assembly 350 by control circuitry 120. Each heater 352 has an inner face that faces toward outer surface 132 of underside 130 of mold 102 and an outer face 356 (FIG. 12) that faces away from outer surface 132 of underside 130 of mold 102. Like heaters 152 and 252 discussed above, each heater 352 includes a ceramic substrate 360 (FIG. 12) having a series of one or more electrically resistive traces 362 (FIG. 12) and electrically conductive traces 364 (FIG. 12) positioned on the ceramic substrate 360. Heat is generated when an electrical current is passed through resistive trace(s) 362 of heaters 352 in order to free ice cubes formed in lobes 136 from inner surface 134 of mold 102 upon activation of heater assembly 350 by control circuitry 120. Conductive traces 364 provide electrical connections to and between resistive trace(s) 362 of each heater 352. Conductive traces 364 also form a pair of terminals 366, 367 (FIG. 12) of each heater 352.

Heaters 352 are electrically connected, e.g., in series, to each other by cables, wires, busbars, or other forms of electrical connections in order to supply voltage to each heater 352 and to facilitate control of heaters 352. In the example embodiment illustrated, a voltage connector 338 is positioned at a first end of mold 102 and electrically connected to a pair of busbars 342, 343 that extend from voltage connector 338 along underside 130 of mold 102. In this embodiment, busbar 342 is electrically connected to a first terminal 366 of each heater 352, and busbar 343 is electrically connected to a second terminal 367 of each heater 352 in order to electrically connect heaters 352 to respective electrical contacts of voltage connector 338. In the embodiment illustrated, an electrically conductive tab 344 is welded (e.g., laser welded or resistance welded) directly to each terminal 366, 367, and in turn welded or soldered directly to a corresponding busbar 342, 343 in order to electrically connect busbars 342, 343 to terminals 366, 367 of each heater 352. In the embodiment illustrated, a mount 339 is positioned at an opposite end of mold 102 from voltage connector 338. Mount 339 receives respective ends of busbars 342, 343 in order to provide additional physical support to busbars 342, 343, but, in the embodiment illustrated, mount 339 does not electrically connect busbars 342, 343. Voltage connector 338 and busbars 342, 343 electrically connect each heater 352 to the voltage source of ice maker 100 and control circuitry 120 that selectively closes the circuit formed heaters 352 and busbars 342, 343 to generate heat from resistive traces 362 of heaters 352. Voltage connector 338 includes a pair of electrical contacts that each contact a respective busbar 342, 343.

Although not shown in FIG. 11, heater assembly 350 may include a cover and thermal insulation as desired. Further, a thermal tape, adhesive, or gap filler may be positioned between an inner face of each heater 352 and outer surface 132 of mold 102 in order to improve heat transfer as desired, and springs or other biasing features may force each heater 352 toward outer surface 132 of mold 102 as desired.

Figure 12:
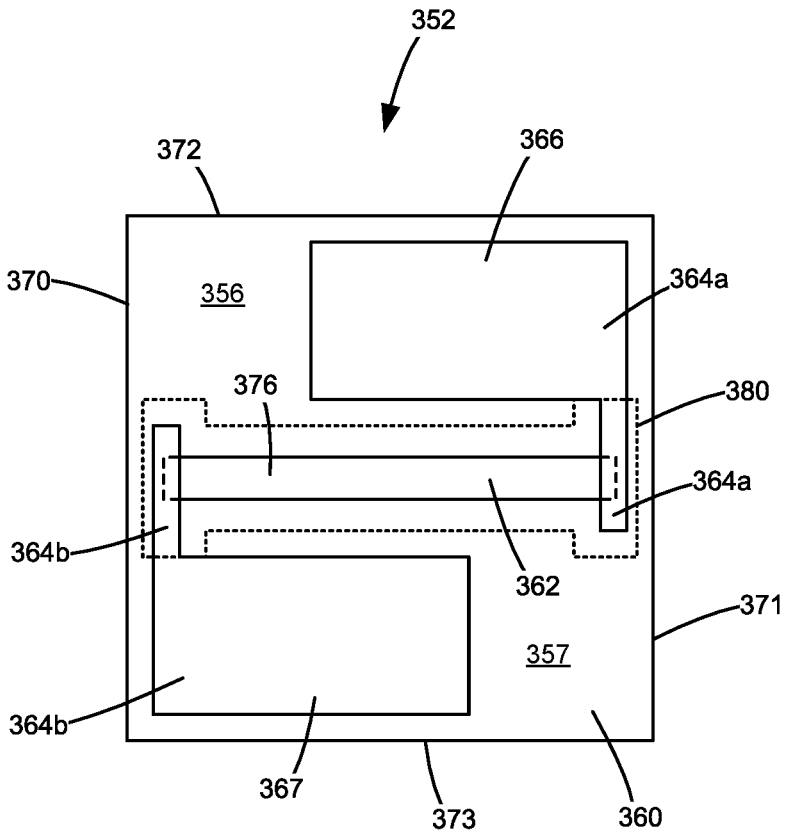
FIG. 12 is a plan view of a heater of the heater assembly shown in FIG. 11 according to one example embodiment.

FIG. 12 shows outer face 356 of a heater 352 according to one example embodiment. In the embodiment illustrated, an inner face of heater 352 and outer face 356 of heater 352 are square shaped; however, other shapes may be used as desired (e.g., other polygons such as a rectangle). Heater 352 includes one or more layers of a ceramic substrate 360 as discussed above. Ceramic substrate 360 includes an outer face 357 that is oriented toward outer face 356 of heater 352 and an inner face that is oriented toward an inner face of heater 352. In the example embodiment illustrated, an inner face of heater 352 is formed by an inner face of ceramic substrate 360. In this embodiment, outer face 357 of ceramic substrate 360 includes an electrically resistive trace 362 and a pair of electrically conductive traces 364*a*, 364*b* positioned thereon. Resistive trace 362 forms a heating element 376 of heater 352. Resistive trace 362 and conductive traces 364*a*, 364*b* may be applied to ceramic substrate 360 by way of thick film printing as discussed above.

In the example embodiment illustrated, resistive trace 362 extends from near a first edge 370 of heater 352 toward a second edge 371 of heater 352, substantially parallel to third and fourth edges 372, 373 of heater 352. In this embodiment, resistive trace 362 is positioned midway between edges 372, 373 of heater 352. Conductive traces 364*a*, 364*b* each form a respective terminal 366, 367 of heater 352. Conductive trace 364*a* directly contacts a first end of resistive trace 362 near edge 371 of heater 352, and conductive trace 364*b* directly contacts a second end of resistive trace 362 near edge 370 of heater 352. Portions of resistive trace 362 obscured beneath conductive traces 364*a*, 364*b* in FIG. 12 are shown in dashed line.

In the embodiment illustrated, heater 352 includes one or more layers of printed glass 380 on outer face 357 of ceramic substrate 360. In the embodiment illustrated, glass 380 covers resistive trace 362 and portions of conductive traces 364*a*, 364*b*, except for portions of terminals 366, 367, in order to electrically insulate such features. The borders of glass layer 380 are shown in dotted line in FIGS. 12 and 13.

Figure 13:
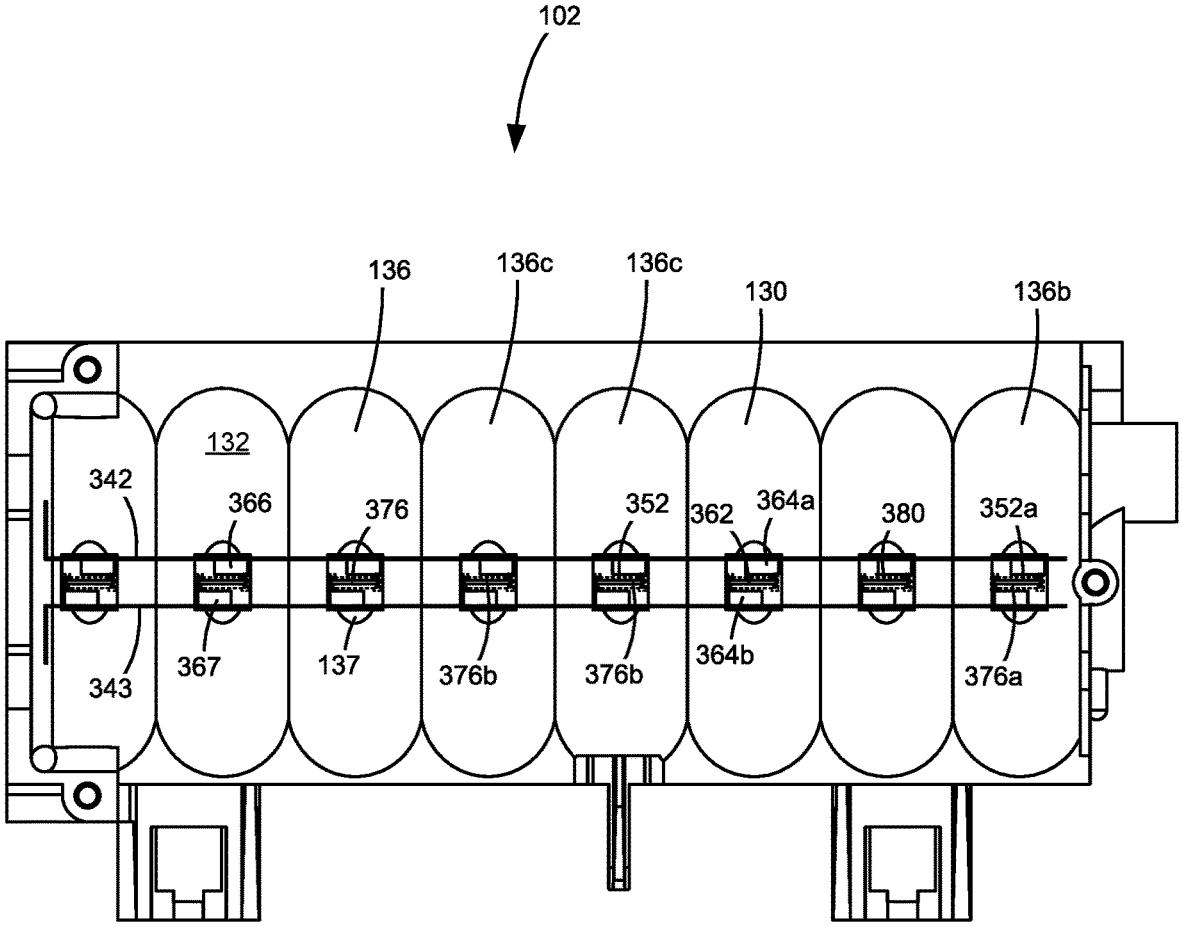
FIG. 13 is a bottom plan view of the ice mold and the heater assembly of FIG. 11 according to one example embodiment.

While the example embodiment illustrated in FIGS. 11-13 includes resistive traces 362, and the heating elements 376 formed thereby, positioned on outer face 357 of ceramic substrate 360, as discussed above, in other embodiments, resistive traces 362, and the heating elements 376 formed thereby, may be positioned on an inner face of ceramic substrate 360 along with corresponding conductive traces as needed to establish electrical connections thereto. Glass 380 may cover the resistive traces and conductive traces on outer face 357 and/or an inner face of ceramic substrate 360 as desired in order to electrically insulate such features.

FIG. 13 shows underside 130 of ice mold 102 with heaters 352 installed thereon. Heaters 352 are aligned with corresponding lobes 136 of mold 102 such that heating elements 376 are positioned to supply heat to each lobe 136 to free ice cubes formed in lobes 136 from inner surface 134 of mold 102 upon activation of heater assembly 350 by control circuitry 120. Busbars 342, 343 extend between lobes 136 of mold 102 in order to electrically connect each heater 352 to voltage connector 338 to electrically connect heaters 352 to the voltage source of ice maker 100 and control circuitry 120.

The embodiments of the heater(s) of ice maker 100 illustrated and discussed above with respect to FIGS. 4-13 are intended as examples and are not exhaustive. The heaters of the present disclosure may include resistive and conductive traces in many different patterns, layouts, geometries, shapes, positions, sizes and configurations as desired, including resistive traces on an outer face of each heater, an inner face of each heater and/or an intermediate layer of the ceramic substrate of each heater. Other components (e.g., a thermistor and/or a thermal cutoff) may be positioned on or against a face of each heater as desired. As discussed above, ceramic substrates of the heater may be provided in a single layer or multiple layers, and various shapes (e.g., rectangular, square or other polygonal faces) and sizes of ceramic substrates may be used as desired. Curvilinear shapes may be used as well but are typically more expensive to manufacture. Printed glass may be used as desired on the outer face and/or the inner face of each heater to provide electrical insulation.

The heaters of the present disclosure are preferably produced in an array for cost efficiency, for example, with each heater in a particular array having substantially the same construction. Preferably, each array of heaters is separated into individual heaters after the construction of all heaters in the array is completed, including firing of all components and any applicable finishing operations. In some embodiments, individual heaters are separated from the array by way of fiber laser scribing. Fiber laser scribing tends to provide a more uniform singulation surface having fewer microcracks along the separated edge in comparison with conventional carbon dioxide laser scribing. In some embodiments, the ceramic substrate of each heater is tape cast and laminated in two green state layers that are oriented such that they have opposing, concave camber when pressed together, dried, and fired. The thickness of each layer of the ceramic substrate may range from, for example, 0.3 mm to 2 mm. For example, commercially available ceramic substrate thicknesses include 0.3 mm, 0.635 mm, 1 mm, 1.27 mm, 1.5 mm, and 2 mm.

The present disclosure provides ceramic heaters having a low thermal mass in comparison with conventional ceramic heaters. In some embodiments, thick film printed resistive traces on an exterior face (outer or inner) of the ceramic substrate provides reduced thermal mass in comparison with resistive traces positioned internally between multiple sheets of ceramic. In some embodiments, thick film printing the resistive and conductive traces on fired ceramic substrate provides more uniform and predictable resistive and conductive traces in comparison with resistive and conductive traces printed on green state ceramic due to relatively large variations in the amount of shrinkage of the ceramic during firing of green state ceramic. The low thermal mass of the ceramic heaters of the present disclosure allows the heater (s), in some embodiments, to heat to an effective temperature for use in a matter of seconds (e.g., less than 5 seconds, or less than 20 seconds), significantly faster than conventional heaters. The low thermal mass of the ceramic heaters of the present disclosure also allows the heater(s), in some embodiments, to cool to a safe temperature after use in a matter of seconds (e.g., less than 5 seconds, or less than 20 seconds), again, significantly faster than conventional heaters. Further, embodiments of the ceramic heaters of the present disclosure operate at a more precise and more uniform temperature than conventional heaters because of the relatively uniform thick film printed resistive and conductive traces. The low thermal mass of the ceramic heaters and improved temperature control permit greater energy efficiency in comparison with conventional heaters.

The relatively low thermal mass of the heaters of the present disclosure allow the heater assembly of ice maker 100 to heat and cool significantly faster than conventional ice maker heaters. As a result, the heaters of the present disclosure may reduce the ice making cycle time to a fraction of the time of conventional ice makers. Aligning the heating elements of the heater(s) with lobes 136 of ice mold 102 of ice maker 100 allows heat to be supplied precisely where it is needed to free ice cubes from mold 102. This further reduces the heating time required to free ice cubes from mold 102 and, in turn, further reduces the ice making cycle time. Aligning the heating elements of the heater(s) with lobes 136 of mold 102 of ice maker 100 also improves the thermal efficiency of ice maker 100 by directing heat to only the portions of mold 102 requiring heat to free ice cubes from the surface of mold 102.

As discussed above, the heater assembly of ice maker 100 may include a single heater (e.g., heater 152 or 252) or multiple heaters (e.g., heaters 352). Where multiple heaters are used, each heater may include a heating element that is aligned with a single lobe 136 of ice mold 102 (as in the example embodiment shown in FIGS. 11-13), each heater may include multiple heating elements that are each aligned with a respective ice lobes 136 of ice mold 102 such that each heater supplies heat to multiple ice lobes 136.

The heater assemblies of the present disclosure can be tailored further to match the heating requirement for each individual ice lobe 136. For example, it may be preferable to provide additional heating to the two outermost ice lobes 136*a*, 136*b*, which have the highest thermal mass, shown in FIG. 3. Further, in the example embodiment shown in FIGS. 4-6, it may be preferable to provide the most heat to the outermost ice lobe 136*b* shown in FIG. 7, which is furthest from terminals 166, 167 of heater 152 and voltage connector 138 and which has the highest thermal mass. In embodiments that include a single heater, the heating elements of the heater may be tailored to have a desired power depending on the heating requirements of the particular lobe 136 that the heating element will be aligned with. For example, heating elements 176*a*, 176*b* shown in FIG. 7 of heater 152 that align with end lobes 136*a*, 136*b* may be printed to have a lower resistance (and therefore higher current and power at a given voltage) than other heating elements 176 (such as heating elements 176*c* aligned with central lobes 136*c*) of heater 152 in order to supply more heat to lobes 136*a*, 136*b*. Lower resistance may be accomplished, for example, by increasing the cross-sectional area (by increasing the thickness and/or width) of the resistive trace forming the heating element, by decreasing the length of the resistive trace, and/or by forming the resistive trace from a material having a lower resistivity. In embodiments that include multiple heaters, the heating element(s) of each heater may be tailored to have a desired power depending on the heating requirements of the lobe 136 on which the heater will be installed. For example, heater 352*a* shown in FIG. 13 that aligns with end lobe 136*b* may be printed to include a heating element 376*a* having a lower resistance than the heating elements 376 (such as heating elements 376*b* aligned with central lobes 136*c*) of other heaters 352 of heating assembly 350 in order to supply more heat to lobe 136*b*, which is furthest from voltage connector 338 and which has the highest thermal mass.

The heater assemblies of the present disclosure may also be easily scaled to accommodate the size of the ice mold 102 of a particular ice maker 100. Larger or smaller ice molds 102 may be required in different applications depending on the amount of ice production needed. In embodiments that include multiple heaters, more or fewer heaters may be used as needed depending on the size of ice mold 102. In embodiments that include a single heater, the substrate of the heater can be lengthened or shortened as needed depending on the size of ice mold 102, and the size and position of the heating elements of the heater can be adjusted by adding, removing or rearranging the resistive traces on the substrate.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An ice maker, comprising:

an ice mold having an inner surface and an outer surface, the inner surface of the ice mold is configured to retain water for forming ice cubes in the ice mold, the ice mold includes a plurality of ice lobes each shaped to form a respective ice cube in the ice mold; and a heater assembly positioned on the ice mold, the heater assembly includes a plurality of heating elements, each of the plurality of heating elements is aligned with an individual corresponding ice lobe of the plurality of ice lobes for supplying heat to ice cubes formed in the ice lobes for releasing the ice cubes from the ice mold, the heater assembly includes a plurality of electrical conductors extending between the plurality of ice lobes and electrically connecting the plurality of heating elements, wherein an electrical power at a given voltage of a first heating element of the plurality of heating elements that is aligned with a first ice lobe of the plurality of ice lobes is greater than an electrical power at said voltage of a second heating element of the plurality of heating elements that is aligned with a second ice lobe of the plurality of ice lobes.

2. The ice maker of claim 1, wherein the heater assembly is positioned along an underside of the ice mold.

3. The ice maker of claim 1, wherein the heater assembly includes a heater having a ceramic substrate, and the plurality of heating elements of the heater assembly are formed by a plurality of electrically resistive traces printed on the ceramic substrate of the heater.

4. The ice maker of claim 3, wherein the plurality of electrical conductors are formed by a plurality of electrically conductive traces printed on the ceramic substrate of the heater.

5. The ice maker of claim 1, wherein the heater assembly includes a plurality of heaters each having a ceramic substrate, each of the plurality of heaters includes at least one electrically resistive trace printed on the ceramic substrate of each of the plurality of heaters, and the plurality of heating elements of the heater assembly are formed by the electrically resistive traces printed on the ceramic substrates of the plurality of heaters.

6. The ice maker of claim 5, wherein the plurality of electrical conductors include a plurality of electrical conductors that electrically connect the plurality of heaters.

7. The ice maker of claim 1, wherein the first ice lobe is an end ice lobe of the plurality of ice lobes and the second ice lobe is a central ice lobe of the plurality of ice lobes.

8. An ice maker, comprising:

an ice mold having an inner surface and an outer surface, the inner surface of the ice mold is configured to retain water for forming ice cubes in the ice mold; and a heater assembly positioned on the outer surface of the ice mold for supplying heat to ice cubes formed in the ice mold for releasing the ice cubes from the ice mold, the heater assembly includes a heater having a ceramic substrate, the ceramic substrate has a plurality of electrically resistive traces thick film printed on the ceramic substrate and at least one electrically conductive trace thick film printed on the ceramic substrate, the heater is configured to generate heat when an electric current is supplied to the plurality of electrically resistive traces, wherein the ice mold includes a plurality of ice lobes each shaped to form a respective ice cube in the ice mold, and each of the plurality of electrically resistive traces is aligned with an individual corresponding ice lobe of the plurality of ice lobes for supplying heat to ice cubes formed in the ice lobes for releasing the ice cubes from the ice mold, wherein an electrical power at a given voltage of a first electrically resistive trace of the plurality of electrically resistive traces that is aligned with a first ice lobe of the plurality of ice lobes is greater than an electrical power at said voltage of a second electrically resistive trace of the plurality of electrically resistive traces that is aligned with a second ice lobe of the plurality of ice lobes.

9. The ice maker of claim 8, wherein the heater assembly is positioned along an underside of the ice mold.

10. The ice maker of claim 8, wherein the first ice lobe is an end ice lobe of the plurality of ice lobes and the second ice lobe is a central ice lobe of the plurality of ice lobes.

11. An ice maker, comprising:

an ice mold having an inner surface and an outer surface, the inner surface of the ice mold is configured to retain water for forming ice cubes in the ice mold, the ice mold includes a plurality of ice lobes each shaped to form a respective ice cube in the ice mold; and a heater positioned on the outer surface of the ice mold, the heater includes a ceramic substrate having a plurality of electrically resistive traces positioned on the ceramic substrate and a plurality of electrically conductive traces positioned on the ceramic substrate, the heater is configured to generate heat when an electric current is supplied to the electrically resistive traces, the plurality of electrically resistive traces are spaced along a length of the ceramic substrate such that each of the plurality of electrically resistive traces is aligned with a corresponding ice lobe of the plurality of ice lobes for supplying heat to ice cubes formed in the ice lobes for releasing the ice cubes from the ice mold, the plurality of electrically conductive traces extend between respective pairs of the plurality of ice lobes and electrically connect the plurality of electrically resistive traces, wherein an electrical power at a given voltage of a first electrically resistive trace of the plurality of electrically resistive traces that is aligned with a first ice lobe of the plurality of ice lobes is greater than an electrical power at said voltage of a second electrically resistive trace of the plurality of electrically resistive traces that is aligned with a second ice lobe of the plurality of ice lobes.

12. The ice maker of claim 11, wherein the heater is positioned along an underside of the ice mold.

13. The ice maker of claim 11, wherein the heater includes a first terminal positioned at a first end of the ceramic substrate along the length of the ceramic substrate and a second terminal positioned at a second end of the ceramic substrate along the length of the ceramic substrate, the first and second terminals providing electrical connections to the heater for electrically connecting the heater to a voltage source.

14. The ice maker of claim 11, wherein the plurality of electrically resistive traces alternate with the plurality of electrically conductive traces in a single file arrangement along the length of the ceramic substrate.

15. The ice maker of claim 14, wherein a width of at least a portion of each electrically conductive trace connecting a respective pair of electrically resistive traces along a width of the ceramic substrate is less than a width of the respective pair of electrically resistive traces along the width of the ceramic substrate.

16. The ice maker of claim 11, wherein the first ice lobe is an end ice lobe of the plurality of ice lobes and the second ice lobe is a central ice lobe of the plurality of ice lobes.

* * * * *